US005402104A

United States Patent [19]

LaRosa

[11] Patent Number: 5,402,104

[45] Date of Patent: Mar. 28, 1995

[54] SCANNING EXCESSIVE SEPARATION ALARM

[76] Inventor: Lazaro LaRosa, 2775 Milburn Ave., Baldwin, N.Y. 11510

[21] Appl. No.: 73,691

[22] Filed: Jun. 9, 1993

[51] Int. Cl.[6] ..... G08B 13/22

[52] U.S. Cl. ..... 340/539; 340/568; 340/571

[58] Field of Search ..... 340/539, 568, 573

[56] References Cited

U.S. PATENT DOCUMENTS 4,549,169 10/1985 Moura et al. ..... 340/539

4,675,656 6/1987 Narcisse ..... 340/539

*Primary Examiner*—Glen Swann

*Attorney, Agent, or Firm*—Michael I. Kroll

[57] ABSTRACT

An asset protection transponder, which may be attached to a set of keys, a car, a brief case, or even a person, transmits a response signal when queried by a transponder-pager worn by the user. The transponder-pager transmits a query signal automatically at appropriate intervals. Each asset protection transponder is on a different frequency and tone encoder setting. The transponder-pager provides both an audible and visible alarm that tells the user which asset is out of range. A test circuit lets the user poll each of the asset protection transducers to make certain that it is still within range.

6 Claims, 2 Drawing Sheets (MINIATURE TRANSMITTER)

SCANNING PAGER

SCANNING EXCESSIVE SEPARATION ALARM

BACKGROUND OF THE INVENTION

The instant invention relates generally to the field of security equipment, and, in particular, to devices that protect personal assets from being stolen or inadvertently left behind. At present there are devices that protect major assets such as automobiles from being driven away without authorization, but there is nothing to prevent an individual from losing valuables such as a wallet, attache case, purse, or car keys, in addition to the car itself. Although not an asset as such, there are not even devices that protect individuals from becoming separated. For example, a very young child can be tethered to its parent but there is nothing to prevent slightly older untethered children from getting lost or kidnapped.

SUMMARY OF THE INVENTION

It is, therefore, a primary object of the present invention to provide an asset protection alarm where small automatic transmitter/receivers, herein called transponders, can be attached to any object or person of interest, so that an accessory transponder-pager, worn or carried by a user, will report when the object or person in issue is separated by a distance greater than some predefined distance.

Another object is to provide an asset protection alarm where each of the asset protection transponders can be differentiated from one another by manually setting each transponder to a slightly different frequency.

Another object is to provide an asset protection alarm where the transponder-pager can sound an audible, speech synthesized, alarm that tells the user which of the assets is now out of range.

A further object is to provide an asset protection alarm where a display screen indicates which asset is out of range by presenting a video display.

A still further object is to provide an asset protection alarm where the maximum permissible distance for each asset is set and stored in the transponder-pager.

A yet further object is to provide an asset protection alarm where the user can manually poll each asset protection transponder to make certain that it is positively still within range.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
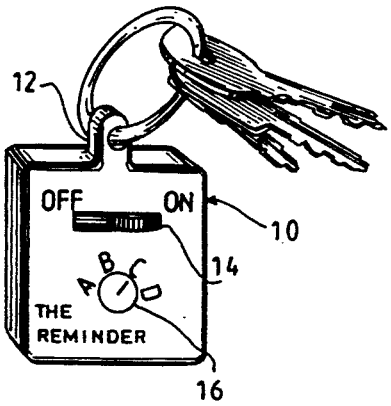
FIG. 1 is a perspective view of one of a multiplicity of miniature asset protection transponders shown attached to a key ring with keys attached thereto.

FIG. 1 illustrates the miniature asset protection transponder 10 with its on-off switch 14 and frequency selector switch 16 which is typically recessed and set using a screwdriver. It is attached to a key ring by key ring attachment ear 12.

Figure 2:
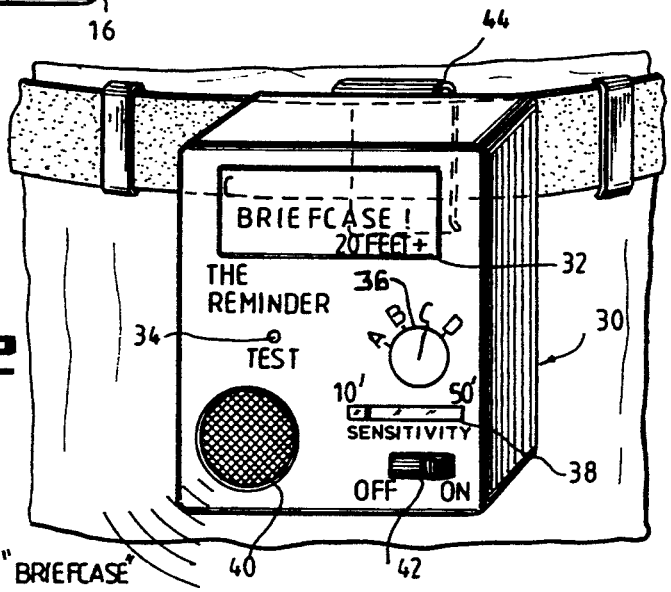
FIG. 2 is a perspective view of the transponder-pager shown worn on a user's belt.

FIG. 2 illustrates the transponder-pager 30 shown attached to a belt using attachment clip 44. The transponder-pager is equipped with an on-off switch 42, a sliding sensitivity potentiometer 38, a frequency selector switch 36, and a test button 34, as well as a speaker 40 and a display 32. The operation of these will be explained below.

Figure 4:
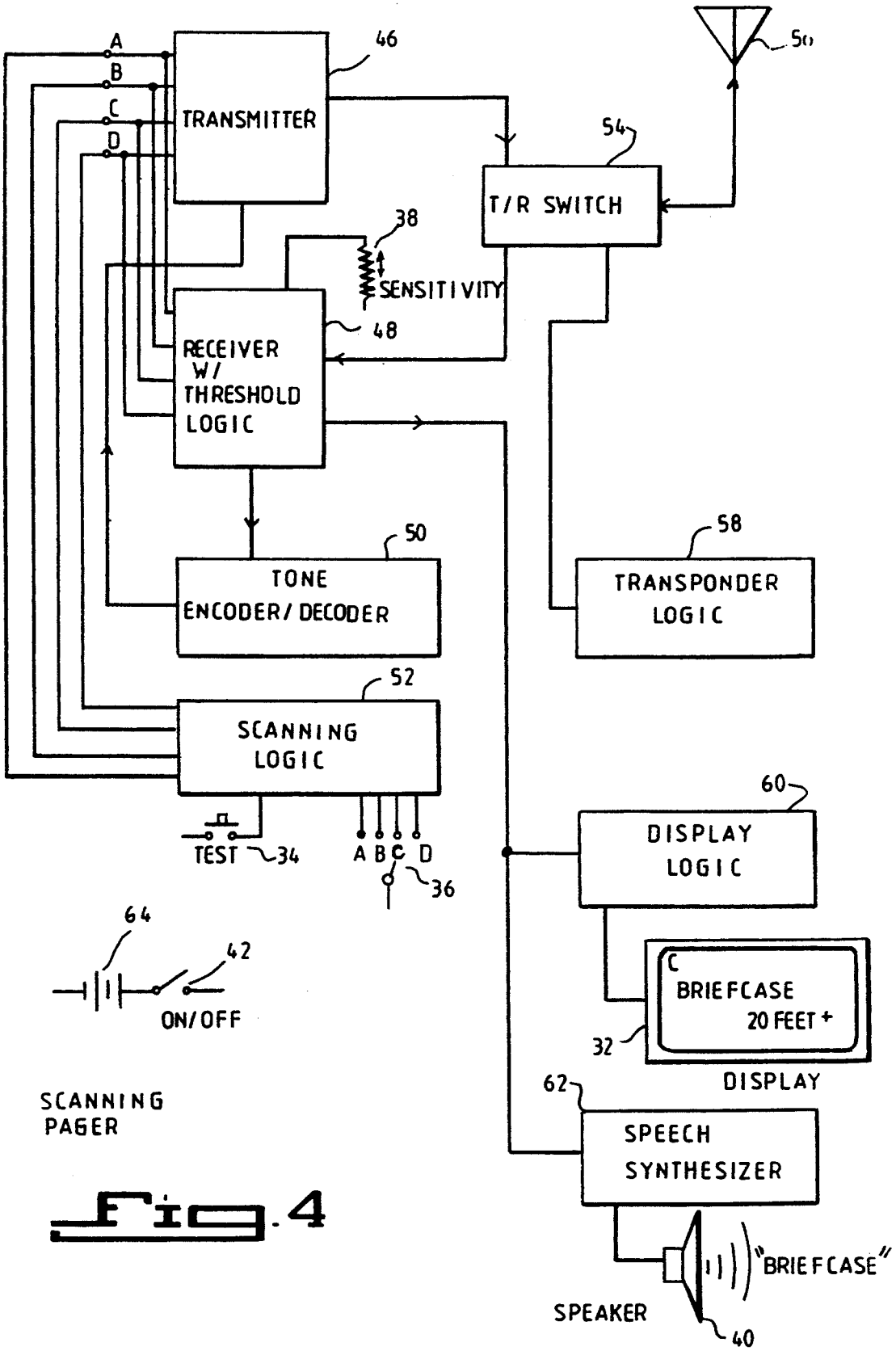
FIG. 4 is an electronic block diagram of the transponder-pager.

In operation, the asset control alarm invention can best be understood by considering its four basic operational modes:

1. transmission by transponder-pager of query signal
2. reception by asset transponder of query signal
3. transmission by asset transponder of response signal
4. reception by transponder-pager of response signal 1. Transmission by transponder of query signal. Refer to FIGS. 2 and 4. The scanning logic circuit 52 automatically selects a frequency on which transmitter 46 will transmit a query signal via T/R switch 54 to antenna 56. The transmitter signal is encoded by tone encoder/decoder 50 so that other transmitters and receiver operating in close proximity do not cause or receive interference. The transponder logic 58 controls transmit/receive functions. Battery 64 supplies power when connected via on/off switch 42.

Figure 3:
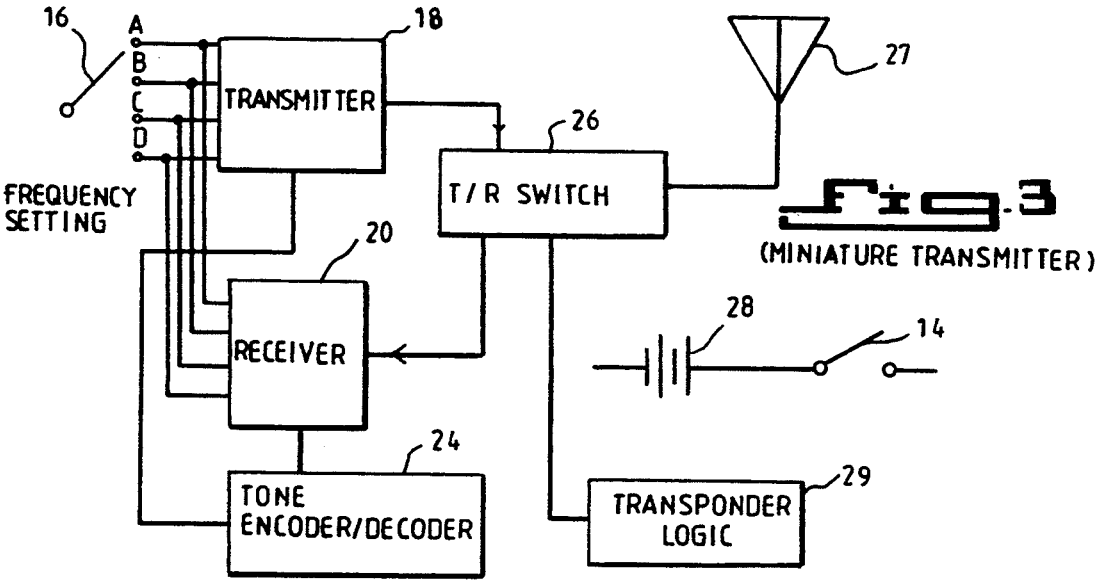
FIG. 3 is an electronic block diagram of the miniature asset protection transponder.

2. Reception by asset transponder of query signal. Refer to FIGS. 1 and 3. The query signal is received by antenna 27 and is transferred to the input of receiver 20 via T/R switch 26. Receiver 20 will only respond to this signal if its encoding matches the decoding provided by tone encoder/decoder 24 and if the signal it receives matches the frequency set by frequency control switch 16. Note that each of frequencies A,B,C, and D are unique to each of four asset transponders. Battery 28 supplies power when connected via on/off switch 14.

3. Transmission by asset transponder of response signal. Refer to FIGS. 1 and 3. Transponder logic 29 senses that a response signal needs to be sent. So it causes transmitter 18 to output a signal whose frequency is that set by frequency control switch 16. This signal is transferred to antenna 27 via T/R switch 26.

4. Reception by transponder-pager of response signal. Refer to FIGS. 2 and 4. The response signal from any of the asset transducers is sensed by antenna 56 and is transferred to receiver 48 via T/R switch 54 whose operation is controlled by transponder logic circuit 58. This signal will only be detected if it is on the frequency automatically set by scanning logic circuit 52 and if is encoded in such a manner that is matched by encoder/decoder 50. In addition, receiver 48 has a threshold circuit such that there is only a receiver output if the signal falls below a threshold set by sensitivity threshold potentiometer 38. Each of the channels represented by frequencies A,B,C and D can have its sensitivity threshold individually set. In this manner the maximum permissible distance for any of the asset protection transponders may be set. Once a signal falls below its preset threshold the user is alerted in two ways: audibly and visually. The alarm output of receiver 48 causes speech synthesizer circuit 62 to output a voice through speaker 40 that says which asset is out of range. Likewise, the alarm output causes display logic circuit 60 to display an alphanumeric output on display 32 that includes the name of the asset, the maximum permissible distance, and the alias (i.e. "C" for "Briefcase").

It should be noted that the transponder methodology permits small lightweight batteries to be used with reasonable battery life because most of the time the power consuming transmitter portions of the asset protection transponders are turned off and the receiver sections are in a low-power standby mode.

The user must be able to verify at any time that the asset under watch is still present and within range. This is accomplished by setting frequency control switch 36 to a particular frequency corresponding to a particular asset and depressing test button 34. If there is no return signal, then the alarm will be activated as described above.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. An asset protection alarm comprising;

one or more miniature asset protection transponders that are attached to assets that are to be protected; and a transponder-pager that is in radio communication with said miniature asset protection transponders such that if the distance between any of said asset protection transponders and said transponder-pager exceeds some preset limit, said pager causes an alarm to sound, said transponder-pager comprising;

a transmitter;

a receiver;

an antenna;

a transmit/receive switch;

a transponder logic circuit; and a scanning logic circuit and alarm means; such that when said transponder-pager initiates a query of all assets, said transmitter outputs a signal whose frequency is determined by said scanning logic circuit, wherein said transmitter output signal is conducted to said antenna via said transmit/receive switch, and wherein if a response signal from an asset protection transponder is received, said signal incident upon said antenna is directed by said transmit/receive switch to said receiver by instructions generated by said transponder logic circuit, wherein the frequency of said receiver is always the same as the frequency of said transmitter, such that if one asset protection transponder is assigned to each of said frequencies, then said receiver will receive a distinguishable signal from each of said asset protection transponders (if each of said asset protection transponders is within range).

2. An asset protection alarm, as recited in claim 1, further comprising an encoder/decoder that causes said receiver to only respond to a particular encoded incoming signal, and also causes said transmitter to output an encoded signal, thereby allowing said asset protection transponder to only communicate with a similarly encoded transponder-pager.

3. An asset protection alarm, as recited in claim 2, wherein said alarm means comprise a threshold logic circuit, a sensitivity control, and electronic notification means, wherein said threshold logic circuit allows said receiver's sensitivity to be set by means of said sensitivity control.

4. An asset protection alarm, as recited in claim 3, wherein said electronic notification means is a video display comprising display logic and an electronic alphanumeric display.

5. An asset protection alarm, as recited in claim 3, wherein said electronic notification means is a speech synthesizer and a speaker.

6. An asset protection alarm, as recited in claim 2, wherein the communication between said asset protection transponders and said transponder-pager may be verified by means of a test circuit comprising a frequency selection switch and a test button, whereby said frequency selector switch may be manually set to a frequency corresponding to one of said asset protection transponders and then said test button may be depressed causing the transmitter of said transponder-pager to initiate a transponder sequence with a selected asset protection transponder.

* * * * *